United States Patent [19]

Bethune et al.

[11] 4,098,399

[45] Jul. 4, 1978

[54] CONTAINER WITH INTEGRAL HANGER BAR

[75] Inventors: Billy R. Bethune, Chattanooga, Tenn.; Larry M. Balkin, Decatur, Ga.

[73] Assignee: Container Corporation of America, Chicago, Ill.

[21] Appl. No.: 823,033

[22] Filed: Aug. 9, 1977

[51] Int. Cl.[2] ..... B65D 85/18

[52] U.S. Cl. ..... 206/288; 206/298; 206/806; 206/297

[58] Field of Search ..... 206/284, 289, 288, 290, 206/295, 297, 298, 299, 806

[56] References Cited

U.S. PATENT DOCUMENTS

| | | | |
|---|---|---|---|
| 1,079,137 | 11/1913 | Gruenberg et al. | 206/290 |
| 3,149,718 | 9/1964 | Wolf | 206/288 |
| 3,259,229 | 7/1966 | Brittingham | 206/289 |
| 3,450,251 | 6/1969 | Simmons | 206/298 |
| 3,565,242 | 2/1971 | Konkoli | 206/290 |

FOREIGN PATENT DOCUMENTS

| | | | |
|---|---|---|---|
| 449,915 | 5/1948 | Canada | 206/299 |

*Primary Examiner*—William Price
*Assistant Examiner*—Joseph M. Moy
*Attorney, Agent, or Firm*—Carpenter & Ostis

[57] ABSTRACT

A garment container formed of paperboard and having an integral hanger supporting bar extending between opposed walls.

1 Claim, 5 Drawing Figures

CONTAINER WITH INTEGRAL HANGER BAR

SUMMARY OF THE INVENTION

This invention relates to shipping containers for garments and more particularly to containers of the type having integral hanger supporting bars formed therein.

It is a primary object of the invention to provide, in a container of the type described, a hanger bar arrangement comprising a post-like bar secured to and extending between opposed side walls of the container adjacent one end thereof.

A more specific object of the invention is the provision, in a container of the type described, of an integral hanger bar cut from material of one of the side walls of the container and extending towards and secured to the opposed side wall.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 4:
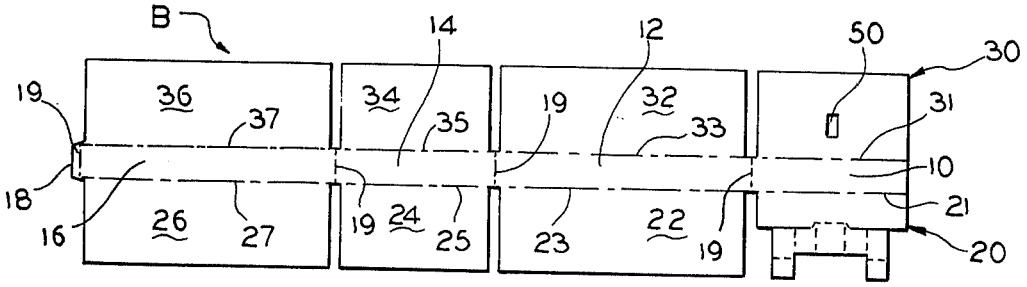
FIG. 4 is a plan view of the blank from which the structure illustrated in the other views may be formed.
Figure 1:
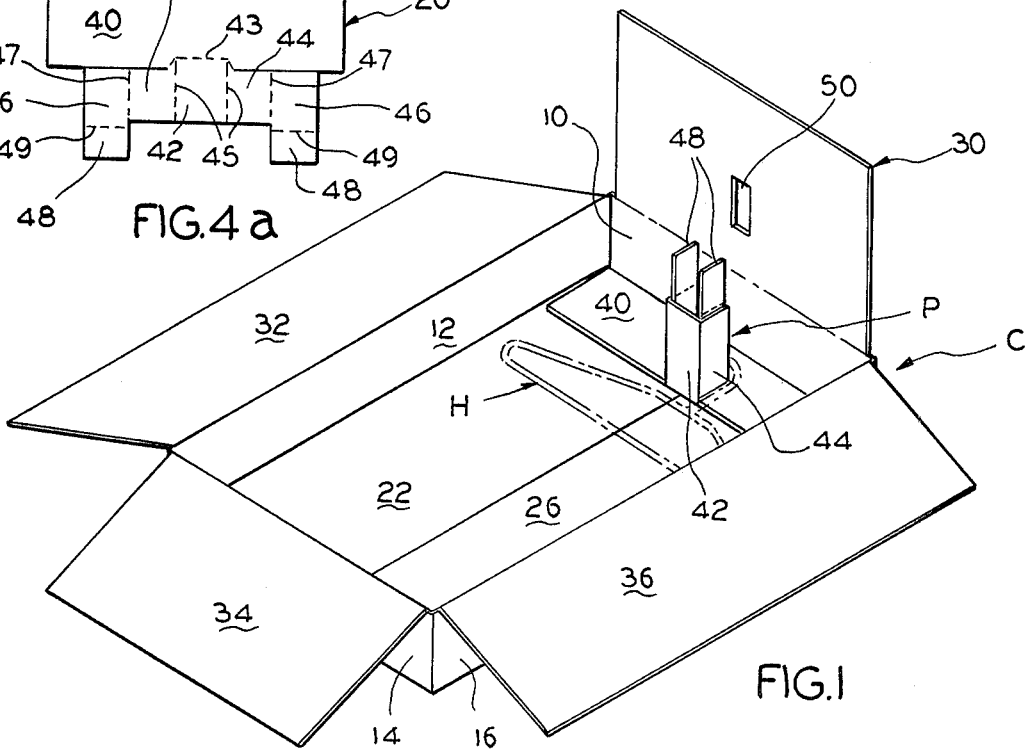
FIG. 1 is a perspective view of a container embodying features of the invention and shown in the open position.

Referring now to the drawings for a better understanding of the invention, it will be seen that the novel shipping container indicated generally at C, as illustrated in FIG. 1, may be formed from the unitary blank B of foldable paperboard illustrated in FIG. 4.

Container C includes a generally integral bar or post P extending between opposed walls of the container and adapted to support at least one garment hanger H.

As best seen in FIG. 4, Container C includes a body portion having a top wall panel 10, a first side wall panel 12, a bottom wall panel 14, a second side wall panel 16 and a glue flap 18 which are foldably joined to each other on parallel fold lines 19 to form a tubular structure open at the front and rear.

The front and rear ends of the tubular structure are closed by front and rear walls each formed from a plurality of overlapping flaps hinged to opposed front and rear edges of the body walls of the container in a manner hereinafter described.

As best seen in FIG. 4, the rear wall of the container includes a top rear closure flap 20, a first side rear closure flap 22, a bottom rear closure flap 24, and a second side rear closure flap 26 foldably joined to the rear edges of top wall 10, first side wall 12, bottom wall 14, and second side wall 16, along fold lines 21, 23, 25 and 27, respectively.

The front wall of the container includes a top front closure flap 30, a first side front closure flap 32, a bottom front side closure flap 34, and a second side front closure flap 36 which are foldably joined to the front edges of top wall panel 10, first side wall panel 12, bottom wall panel 14, and second side wall panel 16 along wall lines 31, 33, 35 and 37, respectively. The flaps of each of the front and rear walls may be folded and secured to each other in overlapping relationship in any desired manner such as by stapled or gluing (not shown). However, it will be understood that the top and bottom closure flaps are disposed to lie under or within the side closure flaps.

Figure 4A:
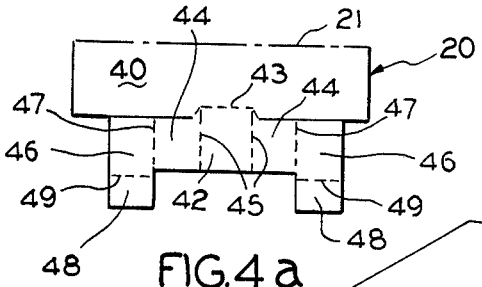
FIG. 4*a* is an enlarged view of a portion of the structure shown in FIG. 4.

In order to support the one or more hangers H, there is provided an integral post P which is formed from the material cut from the top rear closure flap 20. As best seen in FIG. 4*a*, flap 20 includes a base section 40 to which is joined the panels forming the bar or post P as hereinafter described.

Figure 2:
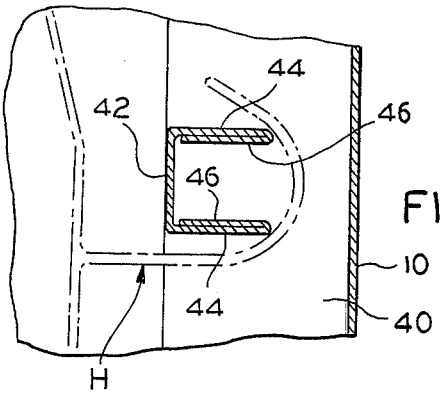
FIG. 2 is a fragmentary plan view of a portion of the structure illustrated in FIG. 1.

Post P is generally U shaped in cross section as seen in FIG. 2, and includes a central panel 42 foldably joined at its rear edge on fold line 43 to a central portion of a lower edge of base section 40. Foldably joined to opposite side edges of central panel 42 along fold lines 45 are a pair of outer side panels 44 which in turn have foldably joined to their upper edges on fold lines 47, a pair of inner side panels 46. Inner side panels 46 are folded 180° to lie in face to face relation with the inside surfaces of outer side panels 44.

As best seen in FIGS. 1 and 4*a*, central panel 42 and outer side panels 44 have a length equal to the depth of the body of the container; whereas, inner side panels 42 have extensions 48 which project above the height of the body of the container and which are foldably joined to the remaining portion of inner side panels 46 on fold lines 49.

Figure 3:
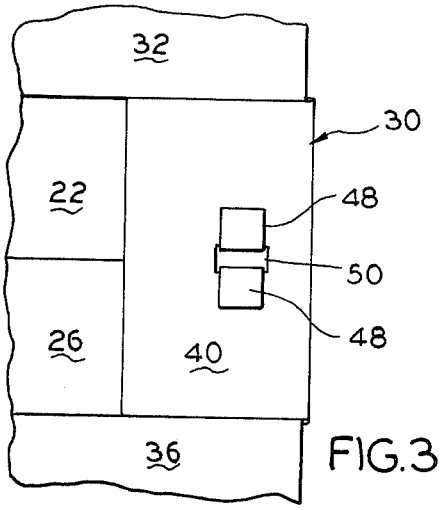
FIG. 3 is a view similar to FIG. 2 but with one of the closure flaps folded to a closed position in interlocking relation with the hanger bar.

When the rear closure flaps are folded into position and the post is formed in a manner previously described, the container will appear as it does in FIG. 1. At this point, after the garments have been placed on the hangers in the container, the top front closure flap 30 and bottom front closure flap 34 are folded inwardly at right angles to their respective body walls. It will be noted that top front closure flap 30 is provided with an aperture 50 adapted to receive the post inner side panel extensions 48 which are then folded downwardly at right angles as best seen in FIG. 3 so as to lie on top of top front closure flap 30 at opposite sides of aperature 50, and to be maintained in this position as they are sandwiched between top front closure flap 34 and first and second front side closure flaps 22 and 32 after they have been folded into position to completely close the container.

Thus it will be seen that there is provided a rigid integral hanger bar cut from material of one of the walls of the container and disposed to extend between opposed walls of the container and be secured to the opposite wall of the container in order to provide a means for supporting a plurality of hangers within the container.

We claim:

1. In a garment container, formed of a unitary blank of foldable paperboard, having an integral hanger bar, the combination of:

(a) top, bottom, and side body walls foldably interconnected to form a tubular construction open at the front and rear;

(b) front and rear sidw walls joined to the front and rear edges of respective top, bottom, and side body walls for closing the front and rear sides of tubular structure;

(c) an integral hanger bar extending transversely between and secured to front and rear walls adjacent the top end of said container for supporting at least one garment hanger thereon;

(d) said hanger bar being generally U-shaped in cross-section.

* * * * *